US010480874B2

(12) United States Patent
Zink

(10) Patent No.: US 10,480,874 B2
(45) Date of Patent: Nov. 19, 2019

(54) PRO-BOXER FLEXIBLE LANCE POSITIONER APPARATUS

(71) Applicant: STONEAGE, INC., Durango, CO (US)

(72) Inventor: Gerald P. Zink, Durango, CO (US)

(73) Assignee: STONEAGE, INC., Durango, CO (US)

( * ) Notice: Subject to any disclaimer, the term of this patent is extended or adjusted under 35 U.S.C. 154(b) by 73 days.

(21) Appl. No.: 15/670,466

(22) Filed: Aug. 7, 2017

(65) Prior Publication Data

US 2018/0058783 A1 Mar. 1, 2018

Related U.S. Application Data

(60) Provisional application No. 62/379,428, filed on Aug. 25, 2016.

(51) Int. Cl.

| | |
|---|---|
| ***F24H 1/12*** | (2006.01) |
| ***B23P 15/26*** | (2006.01) |
| ***F28D 9/00*** | (2006.01) |
| ***F28G 3/16*** | (2006.01) |
| ***F28G 15/02*** | (2006.01) |
| *F28G 15/04* | (2006.01) |

(52) U.S. Cl.
CPC ..... *F28G 3/163* (2013.01); *F28G 15/02* (2013.01); *F28G 15/04* (2013.01)

(58) Field of Classification Search
CPC ... F28G 3/163; F28G 3/10; F28G 3/16; F28G 3/00; F28G 15/02; F28G 15/04; F28F 9/12; B25J 9/043
See application file for complete search history.

(56) References Cited

U.S. PATENT DOCUMENTS 1,095,991 A * 5/1914 Bennett ..... F28G 3/163 122/391
1,441,431 A * 1/1923 Kirgan ..... F28G 3/163 122/390

(Continued)

FOREIGN PATENT DOCUMENTS

EP 0063073 A1 * 10/1982 ..... F22B 37/006
EP 0569080 A1 * 11/1993 ..... F28G 1/163

OTHER PUBLICATIONS https://www.hydraulicspneumatics.com/200/TechZone/FluidPowerAcces/Article/False/6422/TechZone-FluidPowerAcces "Air motor Selection and Sizing", Jan. 1, 2012.*

(Continued)

*Primary Examiner* — Steven S Anderson, II
(74) *Attorney, Agent, or Firm* — Greenberg Traurig, LLP

(57) ABSTRACT

A lance drive support apparatus is adapted to be fastened directly to a heat exchanger tube sheet adjacent a selected number of tubes to be cleaned. One embodiment includes an angled flat base plate having an inner center corner, an outer center corner, a first outer end corner and a second outer end corner, a support post adjacent each outer end corner, and the inner center corner fastened at one end to the base plate, and a top plate fastened to an opposite end of each support post. An extensible scissor arm assembly pivotally fastened to the inner center corner post can position a lance drive mechanism at a distal end of the scissor arm assembly at precise X and Y coordinates adjacent the tube sheet. The precise X and Y coordinates are determined by positions of X and Y cylinders connected to a common scissor arm assembly extension hinge.

20 Claims, 9 Drawing Sheets

(56) References Cited

U.S. PATENT DOCUMENTS

| | | | | |
|---|---|---|---|---|
| 5,017,329 | A * | 5/1991 | Vermaat | F22B 37/005 376/245 |
| 5,355,063 | A * | 10/1994 | Boone | B25J 9/1025 165/11.2 |
| 7,126,882 | B1 | 10/2006 | Lowell | |
| 8,297,093 | B2 * | 10/2012 | Fujita | F22B 37/005 72/53 |
| 2004/0035445 | A1 | 2/2004 | Saxon et al. | |
| 2015/0034128 | A1 * | 2/2015 | Brumfield | B08B 9/0433 134/22.11 |
| 2016/0025433 | A1 | 1/2016 | Mathis | |
| 2016/0209135 | A1 * | 7/2016 | Moring | F28G 15/02 |

OTHER PUBLICATIONS

International Search Report and Written Opinion, dated Nov. 13, 2017, from corresponding International Patent Application No. PCT/US2017/045698.

* cited by examiner

PRO-BOXER FLEXIBLE LANCE POSITIONER APPARATUS

CROSS REFERENCE TO RELATED APPLICATIONS

This application claims the benefit of priority of United States Provisional Patent Application Ser. No. 62/379,428 filed Aug. 25, 2016, entitled Pro-Boxer Flexible Lance Positioner Apparatus, the content of which is incorporated by reference in its entirety.

BACKGROUND OF THE DISCLOSURE

This disclosure generally relates to an apparatus for positioning a flexible high pressure water cleaning lance adjacent a tube to be cleaned protruding through a heat exchanger tube sheet. More particularly, this disclosure describes an apparatus adapted to be mounted or supported directly on a heat exchanger tube sheet rather than being spaced from the tube sheet on a separate frame structure as is currently utilized.

SUMMARY OF THE DISCLOSURE

A flexible lance drive positioning apparatus in accordance with the present disclosure is adapted to be fastened directly to a heat exchanger tube sheet adjacent a selected number of tubes to be cleaned. One embodiment includes an angled flat base plate having an inner center corner, an outer center corner, a first outer end corner and a second outer end corner. This base plate is preferably a right angle base plate having a support post adjacent each outer end corner, the center outer corner and the inner center corner fastened at one end to the base plate. A generally L shaped top plate extending parallel to the base plate is fastened to an opposite end of each support post.

An extensible scissor arm assembly is pivotally fastened to the inner center corner support post that is operable to position a lance drive mechanism held in wrist joint members at a distal end of the scissor arm assembly at precise X and Y coordinates adjacent the tube sheet. The precise X and Y coordinates are determined by positions of X and Y cylinders connected to a common scissor arm assembly extension hinge and to a pin at each end of the L shaped base plate.

The scissor arm assembly preferably includes first and second (i.e., left and right) arms each including a humerus member, an elbow joint, and a radius member and an ulna member connected between the elbow joint and a wrist joint, wherein the first and second arms are independently carried by first and second shoulder sleeves rotatably fastened to the center corner post. The scissor arm assembly further has first and second hinged extensions each having one end rigidly attached to one of the shoulder sleeves and an opposite end pivotally attached together at the common scissor arm assembly extension hinge. The X coordinate actuator preferably has one end fastened to the base plate adjacent the first outer end corner. A Y coordinate actuator preferably has one end fastened to the base plate adjacent the second outer end corner of the base plate.

One embodiment of a flexible lance drive positioning apparatus in accordance with the present disclosure is preferably adapted to be fastened directly to a heat exchanger tube sheet adjacent a selected number of tubes to be cleaned. An embodiment includes a right angled flat base plate having an inner center corner, an outer center corner, a first outer end corner and a second outer end corner, a support post fastened at one end to the base plate adjacent each outer end corner, the center outer corner and the inner center corner, a top plate fastened to an opposite end of each support post, and an extensible scissor arm assembly pivotally fastened to the inner center corner support post.

The extensible scissor arm assembly in this exemplary embodiment is operable to position a lance drive mechanism held in wrist joint members at a distal end of the scissor arm assembly at precise X and Y coordinates adjacent the tube sheet. The scissor arm assembly preferably comprises first and second arms each including a humerus member, an elbow joint, and an ulna member connected between the elbow joint and a wrist joint, wherein the first and second arms are independently carried by first and second shoulder sleeves rotatably fastened to the center corner post. The scissor arm assembly comprises first and second hinged extensions each having one end rigidly attached to one of the shoulder sleeves and an opposite end pivotally attached together at the common scissor arm assembly extension hinge. The apparatus also includes an X coordinate actuator having one end fastened to the base plate adjacent the first outer end corner and a Y coordinate actuator having one end fastened to the base plate adjacent the second outer end corner. The X coordinate actuator and a Y coordinate actuator each having an extendable end fastened together at a common scissor arm assembly extension hinge.

These and other embodiments in accordance with the present disclosure will become more apparent upon a reading and understanding of the following detailed description of various embodiments when taken in conjunction with the drawings.

DETAILED DESCRIPTION

Figure 1:
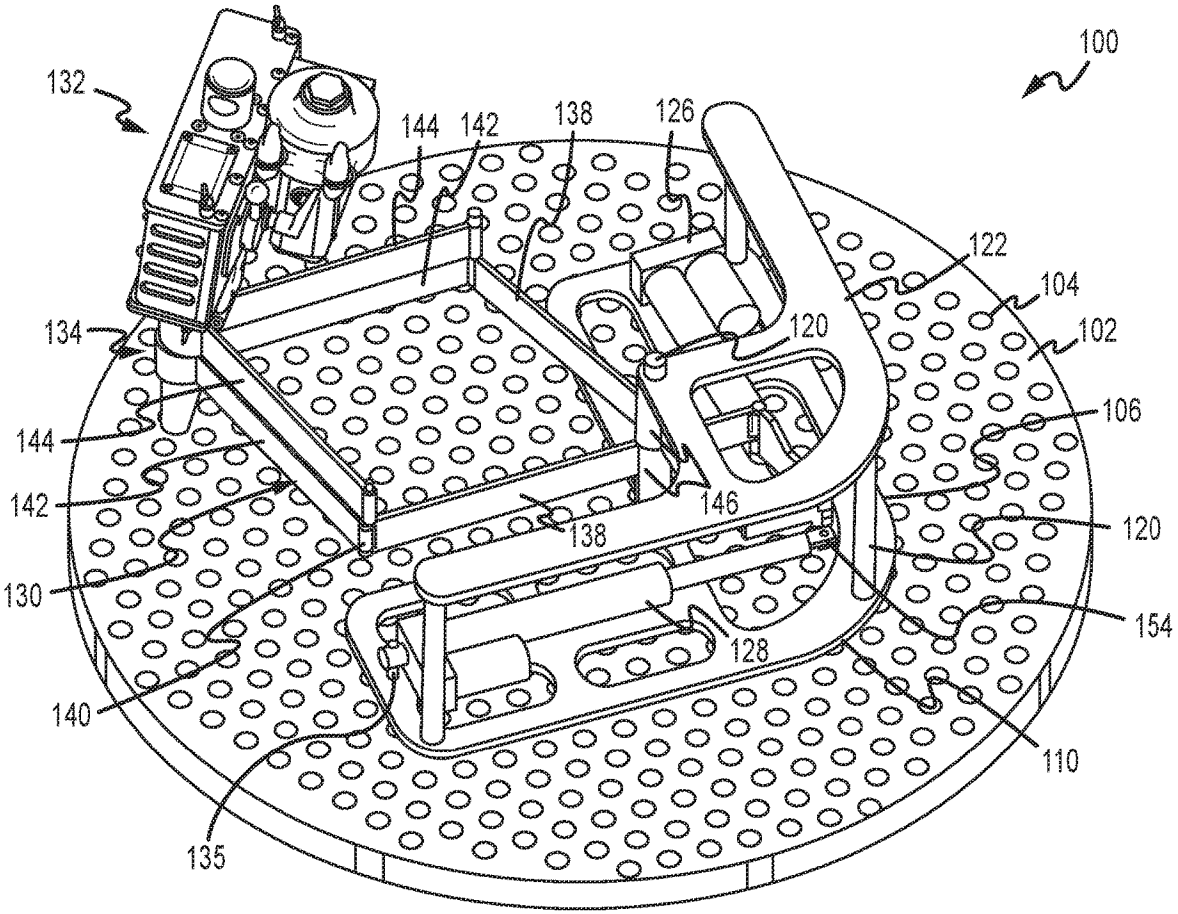
FIG. 1 is a perspective view of an embodiment in accordance with the present disclosure positioned on a heat exchanger tube sheet.
Figure 2:
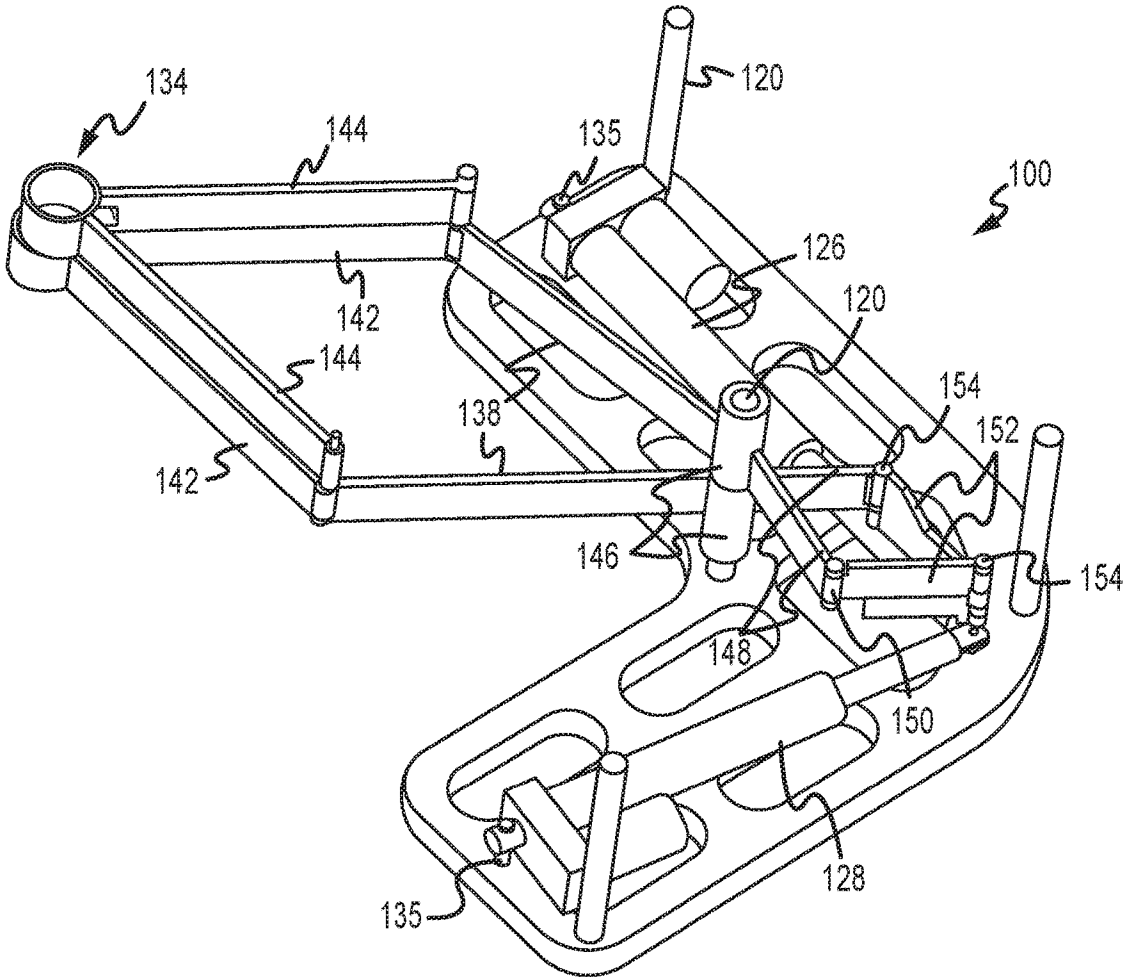
FIG. 2 is a separate perspective view of the dual arm assembly on the base plate in accordance with the present disclosure with the top plate removed.

An exemplary embodiment of a flexible lance drive positioning apparatus 100 adapted to be fastened directly to a heat exchanger tube sheet 102 adjacent a selected number of tubes 104 to be cleaned is shown in a perspective view in FIG. 1. This apparatus 100 is separately shown in the perspective view in FIG. 2. A perspective view of the support frame elements is separately shown in FIG. 3 placed on a tube sheet 102.

Figure 3:
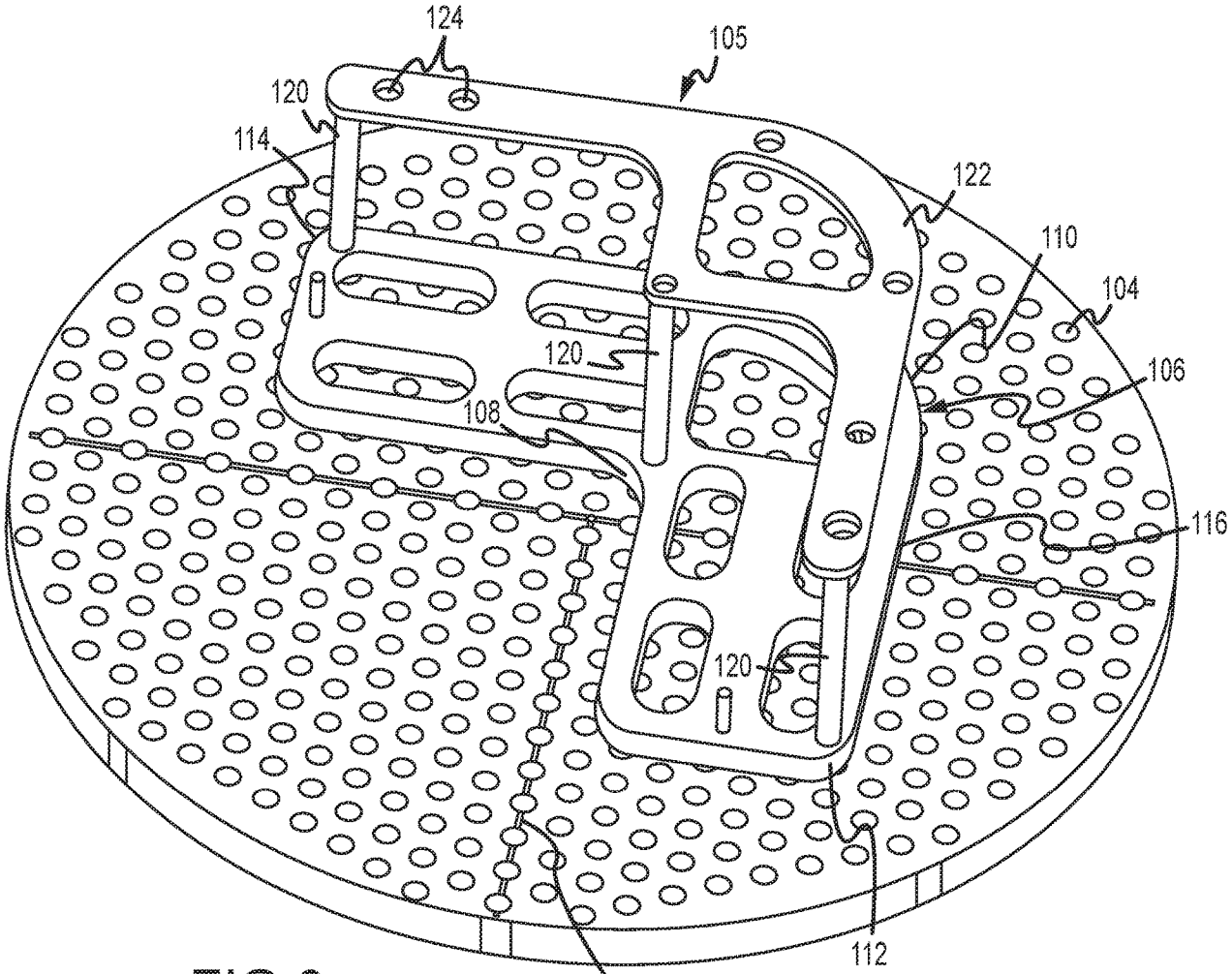
FIG. 3 is a perspective view of the frame without the dual arm assembly on the base plate positioned on a tube sheet and aligned for cleaning operations in an exemplary quadrant of the tube sheet.
Figure 4:
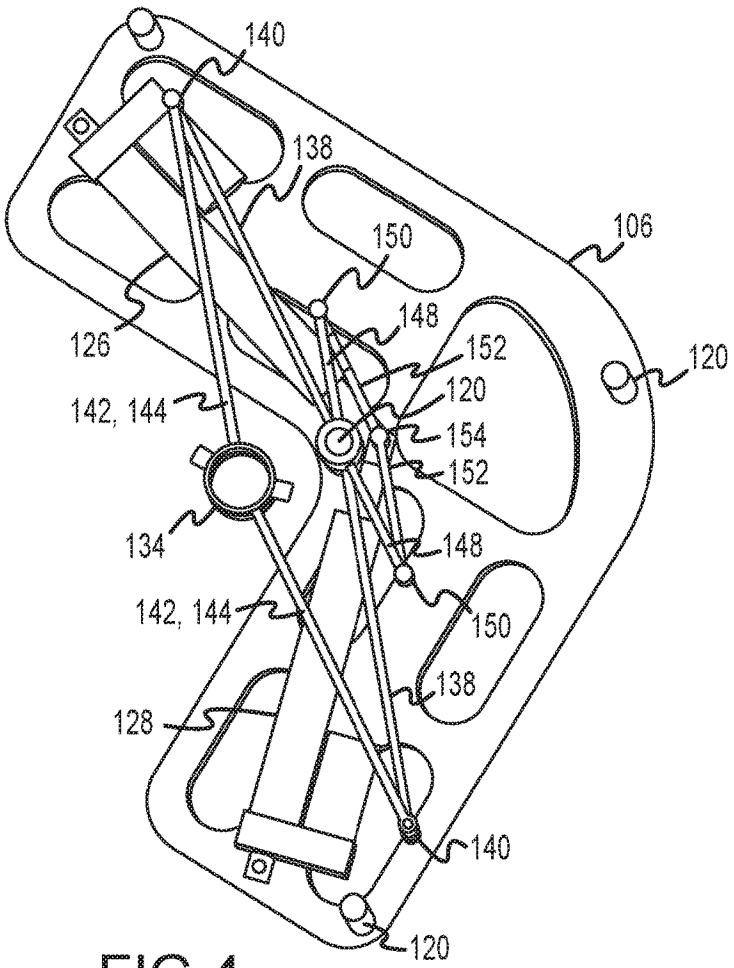
FIG. 4 is a perspective view similar to FIG. 1 with the drive assembly positioned close to a center tube in the tube sheet array of tubes.
Figure 5:
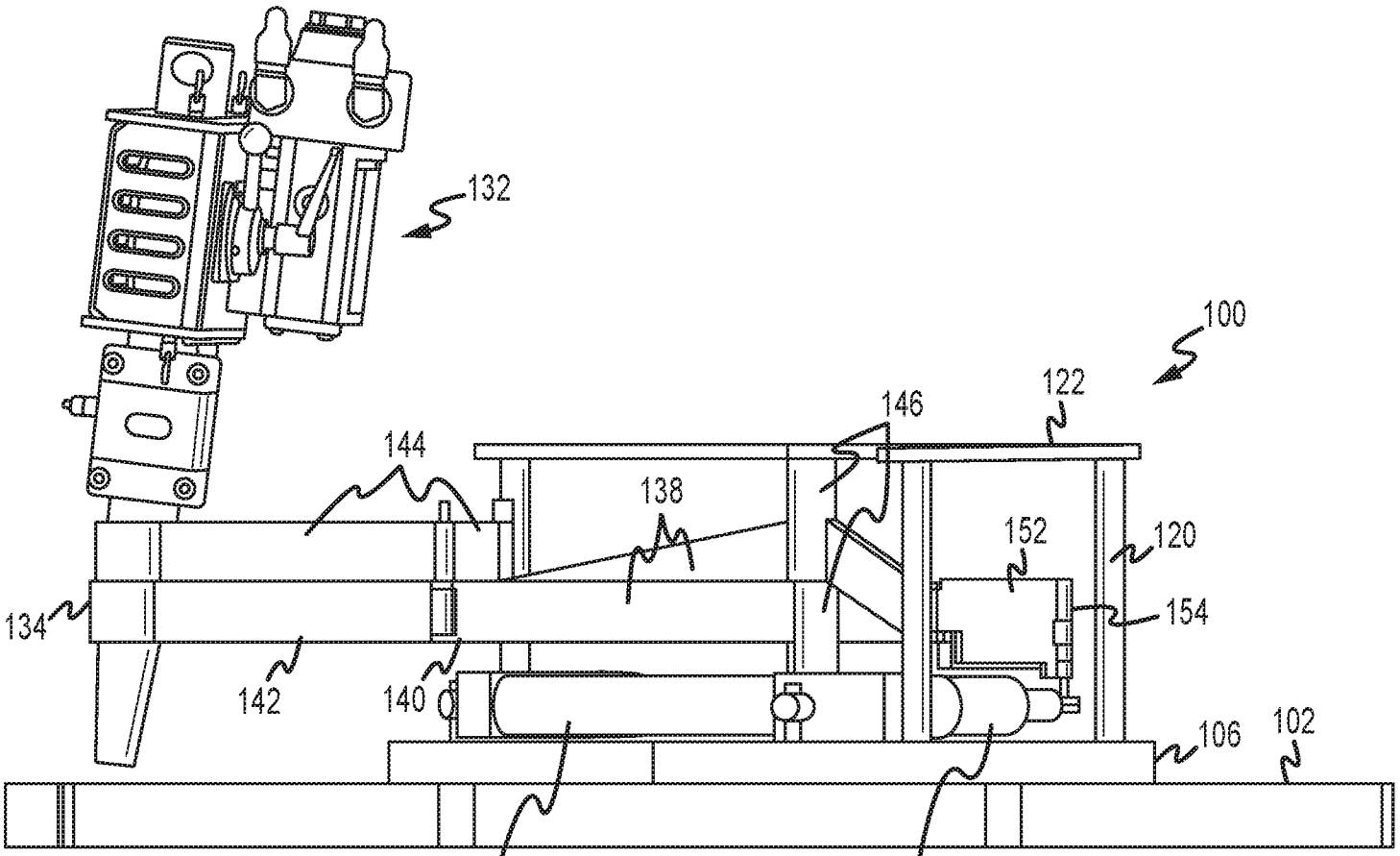
FIG. 5 is a side view of the assembly shown in FIG. 1 illustrating the wall clearance that may be provided in the apparatus according to the present disclosure depending on elbow hinge pin choice.

This apparatus 100 has a frame 105 including an angled flat base plate 106 having an inner center corner 108, an outer center corner 110, a first outer end corner 112 and a second outer end corner 114. In the embodiment 100 shown in FIG. 1, the base plate 106 has a generally right angle flat shape, with all corners preferably rounded. The right hand edge 116 of the plate 106 is aligned parallel to an exemplary row 118 of tubes 104 as shown in FIG. 3. While the base plate 106 extends at a right angle with the center corner 108 centrally located, the base plate 106 could be shaped so that each leg extends at a different angle, for example, at an angle of 120° rather than 90°. Such an arrangement would permit alignment of the tool in registry with a larger number of tubes 104 to be cleaned.

A vertical support post 120 is mounted to the base plate 106 adjacent each outer end corner 114 and 112, the center outer corner 116 and the inner center corner 108. Each post 120 is fixedly fastened at one end to the base plate. The other end of each post 120 is fastened to a flat top plate 122 having a generally boomerang outer edge shape in the embodiment 100 shown. This top plate 122 preferably has a plurality of spaced strap holes 124 therethrough tor an operator to strap or otherwise securely fasten the frame 105 on the tube sheet 102. The top plate 122 may be removably fastened to an opposite end of each support post 120.

An extensible scissor arm assembly 130 is pivotally fastened to the inner center corner support post 120. This assembly 130 is operable to position a lance drive mechanism 132 (shown in FIG. 1) held in a wrist joint assembly 134 at a distal end of the scissor arm assembly 130 at precise X and Y coordinates adjacent the tube sheet 102. The precise X and Y coordinates are determined by positions of X and Y actuator cylinders 126 and 128 respectively connected between pins 135 on the base plate 106 and a common scissor arm assembly extension hinge 154.

The scissor arm assembly 130 comprises a pair of first and second arms that each has a humerus member 138, an elbow joint 140 and an ulna member 142 connected between the elbow joint 140 and the wrist joint assembly 134. Preferably each scissor arm assembly 130 also includes a radius member 144 extending generally parallel to but separate from the ulna member between the elbow joint 140 and the wrist joint assembly 134.

Each of the humerus members 138 has one end connected to one of the elbow joints 140. The elbow joint 140 supports one end of the ulna member 142 and one end of the radius member 144 each for rotation about a vertical axis through the distal end of the humerus member 138. The length of the radius member 144 and ulna members 142 are slightly different, with the ulna member 142 being slightly longer than the radius member 144. The elbow joint 140 supports the radius and ulna members in vertical alignment. Since the ulna member 142 is slightly longer, the wrist assembly 134 will support the drive mechanism 132 is a slightly tilted orientation when the arms of the assembly 130 are extended to the outer holes 104 in the tube sheet 102 as is shown in FIG. 1. By way of example, this distance may be about 0.1 inch for a radius member of about 10 inches in length. The length of the ulna member is preferably slightly longer than a 10 inch radius member by about 0.1 inch. These differences in length become additive as the arms are extended outward from the inner center corner support post 120 to the outer edge of the heat exchanger flange 102. This causes the wrist assembly 134 to be canted inward such that a flexible lance drive mechanism 132 mounted to the wrist assembly 134 will be canted slightly toward the center of the apparatus 100. This is done to accommodate close quarter configurations wherein the heat exchanger tube sheet access is restricted.

The opposite end of each humerus member 138 is fixed to a shoulder sleeve 146 that is rotatably mounted on the inner center corner post 120. In line with the humerus member 138 and fixed to an opposite side of the sleeve 146 is a humerus extension 148. Each of the humerus extensions 148 is connected via a hinge 150 to an actuator linkage 152 which is rotatably pinned at a common connection point 154 to the distal ends of each of the pistons extending from the X and Y actuator cylinders 126 and 128.

The X and Y actuators 126 and 128 are linked together at the common connection point 154. Each actuator has its opposite end pivotally mounted to the base plate 106 at one of the base plate ends. By precisely mapping the extension and retraction location of each of the actuators a precise x and y coordinate at the common connection point 154 can be achieved. At the same time, this precise x and y coordinate will necessarily be transposed to a corresponding precise position of the wrist assembly 134 through the arm linkage described above.

Figure 6:
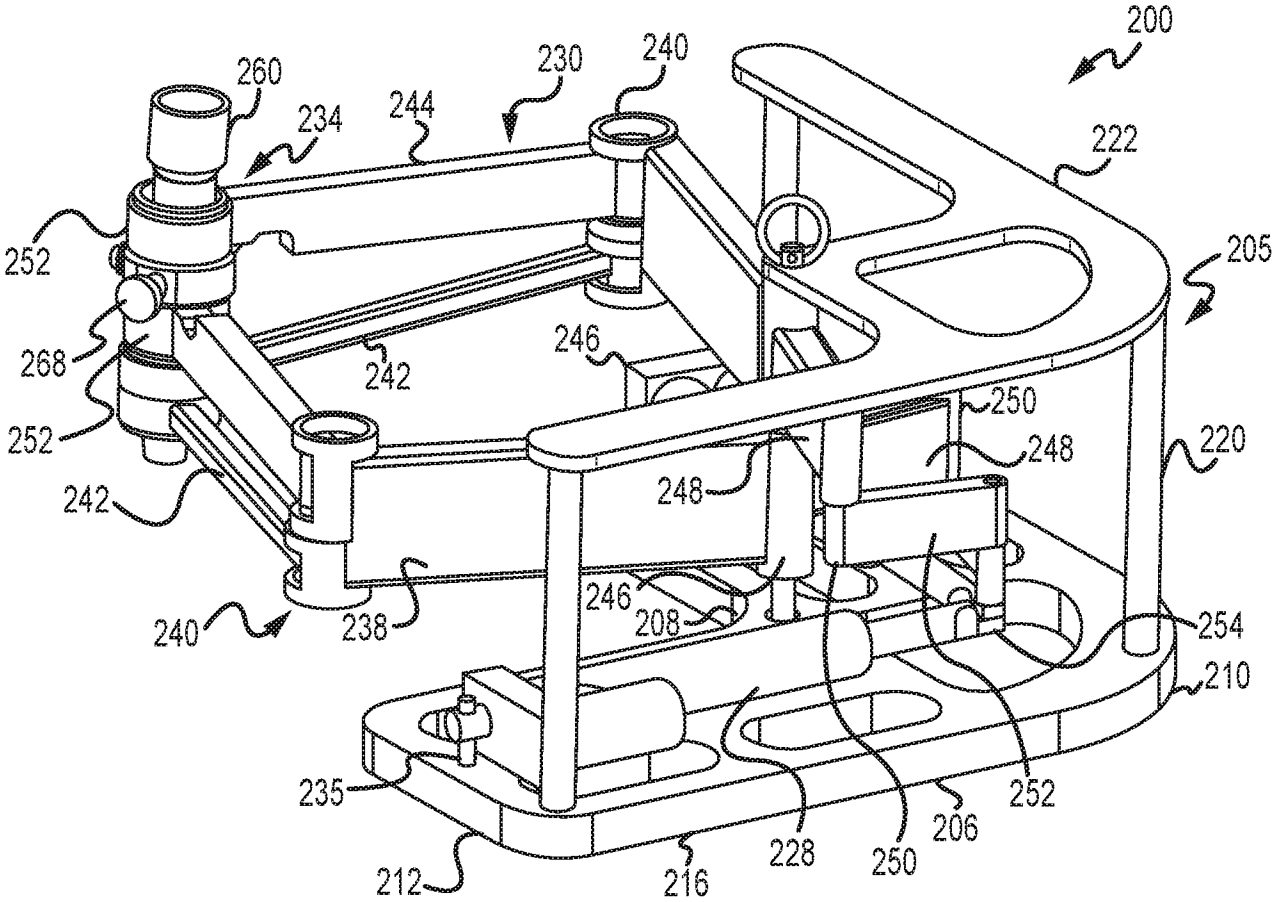
FIG. 6 is a perspective view of another embodiment of an apparatus in accordance with the present disclosure.
Figure 7:
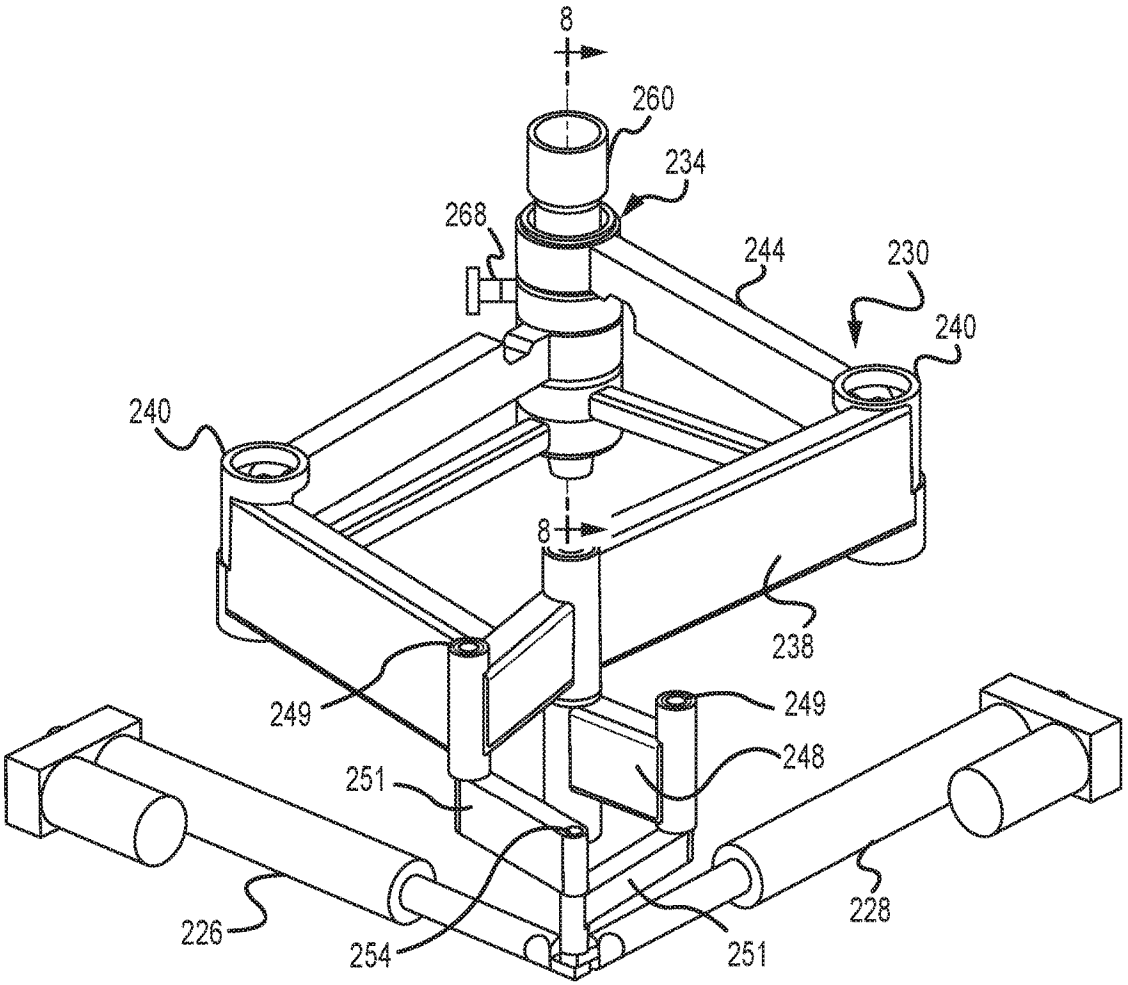
FIG. 7 is a rear perspective view of the apparatus shown in FIG. 6 without the frame being shown.

Another embodiment of an apparatus 200 in accordance with the present disclosure is shown in FIGS. 6-9. This embodiment 200 is similar to apparatus 100 except that the relative positions of the radius and ulna members are reversed. Turning now to FIG. 6, the positioning apparatus 200 is shown in a perspective view similar to that of FIG. 1 except that the tube sheet 102 and lance drive mechanism 132 are not shown.

Apparatus 200 has a frame 205 including an angled flat base plate 206 having an inner center corner 208, an outer center corner 210, a first outer end corner 212 and a second outer end corner 214 (obscured by actuator 226). In the embodiment 200 shown in FIG. 6, the base plate 206 has a generally right angle flat shape, with all corners preferably rounded. The right hand edge 216 of the plate 206 is designed to be aligned parallel to an exemplary row 118 of tubes 104 as shown in FIG. 3. Again, while the base plate 206 extends at a right angle with the center corner 208 centrally located, the base plate 206 could be shaped so that each leg extends at a different angle, for example, at an angle of 120° rather than 90°. Such an arrangement would permit alignment of the tool in registry with a larger number of tubes 104 to be cleaned.

A vertical support post 220 is mounted to the base plate 206 adjacent each outer end corner 214 and 212, the center outer corner 216 and the inner center corner 208. Each post 220 is fixedly fastened at one end to the base plate 206. The upper end of each post 220 is fastened to a flat top plate 222 having a generally right angle outer edge shape in the embodiment 200 shown. This top plate 222 preferably has a plurality of spaced strap holes 124 therethrough for an operator to strap or otherwise securely fasten the frame 205 on the tube sheet 102. The top plate 222 may be removably fastened to an opposite end of each support post 220 as in the first embodiment.

An extensible scissor arm assembly 230 is pivotally fastened to the inner center corner support post 220. This assembly 230 is operable to position a lance drive mechanism 132 (shown in FIG. 1) held in a wrist joint assembly 234 at a distal end of the scissor arm assembly 230 at precise X and Y coordinates adjacent the tube sheet 102. The precise X and Y coordinates are determined by positions of X and Y actuator cylinders 226 and 228 respectively connected between 235 at opposite ends of the base plate 206 and a common scissor arm assembly extension common connection point 254.

The scissor arm assembly 230 comprises a pair of first and second arms that each has a humerus member 238, an elbow joint 240 and an ulna member 242 connected between the elbow joint 240 and the wrist joint assembly 234. Preferably each arm 232 of the scissor arm assembly 230 also includes a radius member 244 extending generally parallel to but separate from the ulna member 242 between the elbow joint 240 and the wrist joint assembly 234. The radius member 244 is mounted above the ulna member 242 at the wrist joint assembly 234 and the elbow joint 240.

Each of the humerus members 238 has one end connected to one of the elbow joints 240. The opposite end of each humerus member 238 is fixed to a shoulder sleeve 246 that is rotatably mounted on the inner center corner post 220. In line with the humerus member 238 and fixed to an opposite side of the sleeve 246 is a humerus extension 248. Each of the humerus extensions 248 is connected via a hinge 249 to an actuator linkage 251 which is rotatably pinned at a common connection point 254 to the distal ends of each of the pistons extending from the X and Y actuator cylinders 226 and 228.

The X and Y actuators 226 and 228 are linked together at the common connection point 254. Each actuator has its opposite end pivotally mounted to the base plate 206 via pins 235 at one of the base plate ends. By precisely mapping the extension and retraction location of each of the actuators a precise x and y coordinate at the common connection point 254 can be achieved. At the same time, this precise x and y coordinate will necessarily be transposed to the corresponding position of the wrist assembly 234 through the arm linkage described above.

Figure 8:
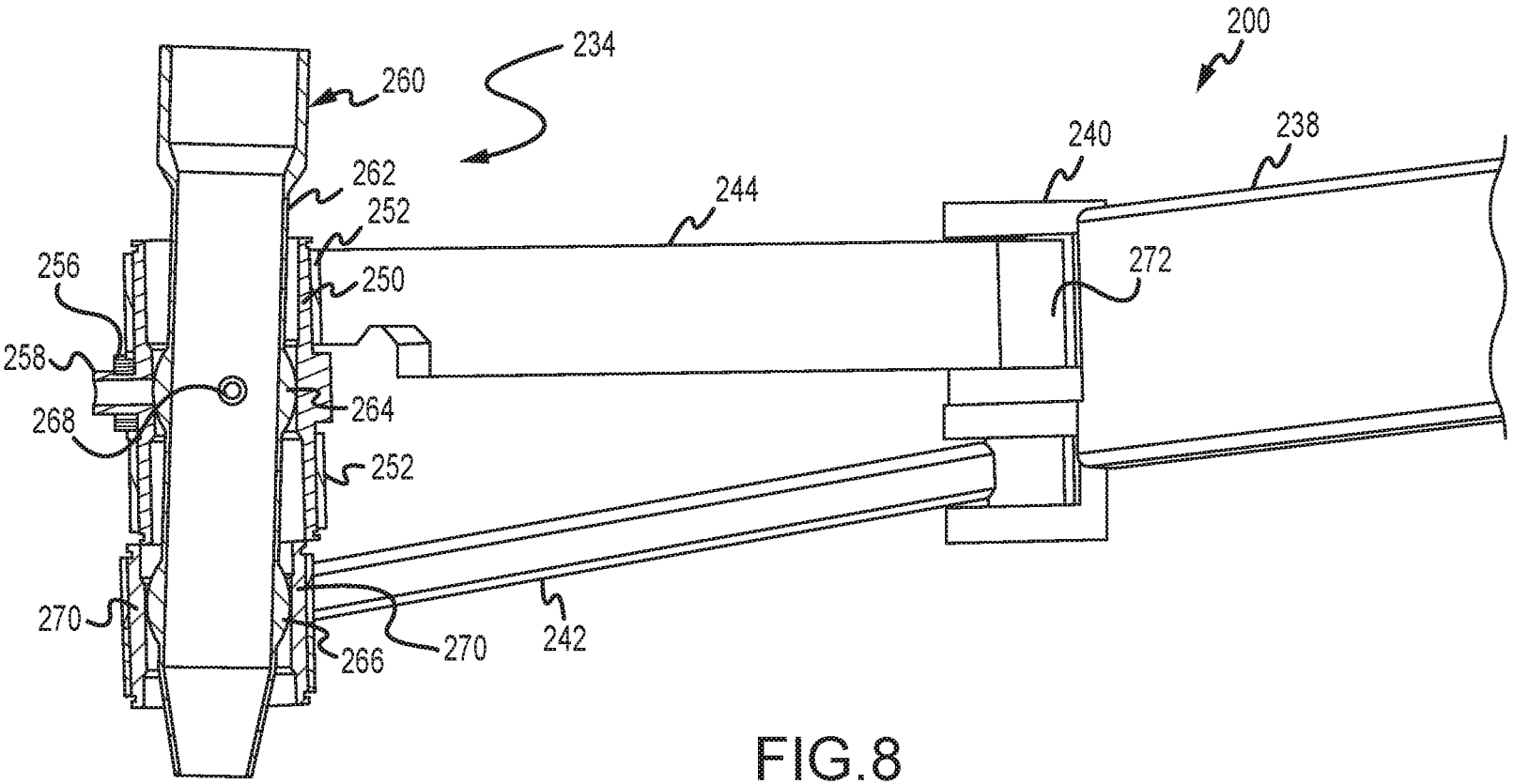
FIG. 8 is a partial vertical sectional view through the wrist assembly of the apparatus taken along the line 8-8 in FIG. 7.
Figure 9:
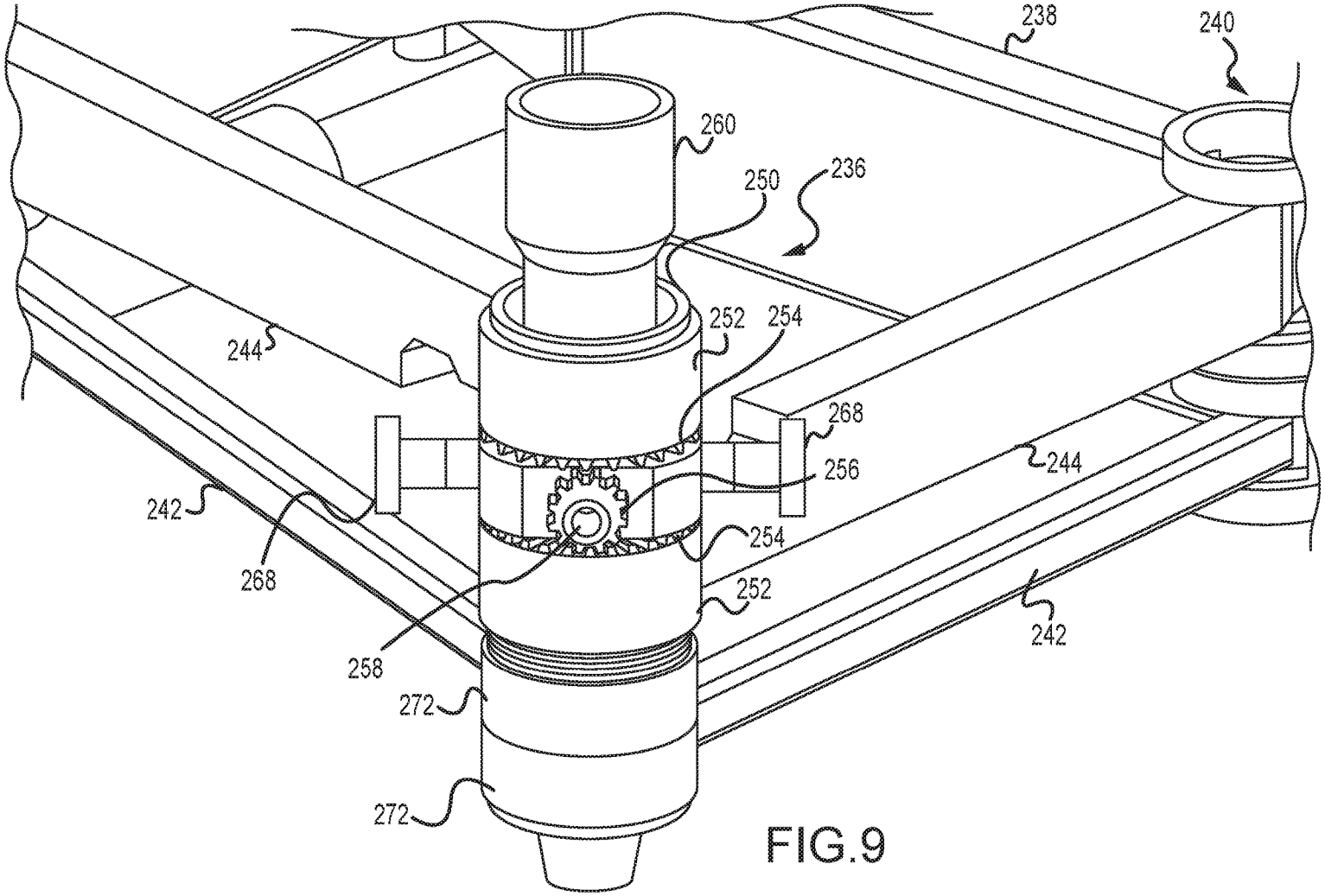
FIG. 9 is a front end perspective view of the apparatus shown in FIG. 6.

A partial vertical sectional view through the wrist assembly 234 is shown in FIG. 8. The wrist assembly 234 comprises an upper wrist journal sleeve 250 and a lower wrist ulna journal sleeve 270. As shown in FIG. 8, the right radius member 244 has one sleeve end 272 rotatably fastened to the right elbow joint 240. The other end of the right radius member 244 is fixed to an upper radius sleeve 252 that rotates on an upper portion of a wrist tube journal 250. One end of the left radius member 244 (not visible in FIG. 8) is fixed to a lower radius sleeve 252 that rotates on a lower portion of the wrist tube journal 250.

The lower edge or rim of the upper radius sleeve 252 has gear teeth 254 that mesh with a follower gear 256 (See FIG. 9) that rotates on a radial pin 258 fixed to the upper portion of the wrist tube journal 250. Similarly, the upper edge or rim of the lower, or left radius sleeve 252 fixed to the left radius member 244 has identical gear teeth 254 that mesh with the follower gear 256 such that proper orientation of the drive apparatus 132 is maintained parallel to the wall as radial position of the arms varies according to movement of the X and Y actuators.

A flexible lance guide tube 260 is removably pinned via spring lock pins 268 within the wrist tube journal 250. This guide tube 260 is a generally cylindrical tubular body 262 that has an upper spherical external bulge portion 264 and a lower spherical external bulge portion 266 each to accommodate tilt of the guide tube 260 in the wrist tube journal 250 and the ulna wrist tube journal 270 respectively, as shown in FIG. 8. Guide tube 260 is pinned via removable lock pin 268 within the journal 250 such that the guide tube 260 can rotate about the pin 268 but cannot be withdrawn from the wrist assembly 234. Removal of the pin 268 permits the guide tube 260 to be withdrawn from the wrist assembly 234. The lock pin 268 is preferably a spring loaded retractable pin.

The distal ends of each ulna member 242 are ring shaped sleeves 272 that rotate one atop the other on the ulna wrist tube journal 270. These sleeves 272 are retained on the journal 270 via snap rings, not shown. Preferably the journals 270 and 250 are retained together such that they may move laterally but not vertically relative to each other. This may be done via an elastomeric sleeve between the two journals, for example.

If the tube sheet 102 is small enough, for example, containing on the order of 48-72 tubes, for example, then the apparatus 100 or 200 could be mounted adjacent the tube sheet and all of the tubes 104 accessed as if in a single section or quadrant, in a manner as described above. Furthermore, the apparatus 100 and 200 described above need not be utilized with circular tube sheets as shown. It may also be adapted to and applied to any tube sheet configuration providing end on access to tubes to be cleaned. For example, the apparatus 100, 200 may be configured to ride on a rail or a cart parallel to a rectangular tube sheet typical of an air fin fan cooler heat exchanger. In such a configuration the apparatus 100, 200 may be programmed to repeatedly be indexed in alignment with sequential groups of tubes in the linear array. Alternatively such an apparatus could be mounted on a wheeled carriage for positioning the apparatus along a catwalk adjacent to such an air fin fan cooler heat exchanger tube sheet.

The apparatus 100 and 200 need not have an L shaped base plate 106 or 206. The base plate may be more rectangular in external shape. The actuators 126, 226 and 128, 228 may each be fastened at one end to one of the corner posts 120, 220 rather than separate pins 135, 235.

Accordingly, many changes may be made to the apparatus as described above. All such changes, alternatives and equivalents in accordance with the features and benefits described herein, are within the scope of the present disclosure. Such changes and alternatives may be introduced without departing from the spirit and broad scope of this disclosure as defined by the claims below and their equivalents.

What is claimed is:

1. A flexible lance drive positioning apparatus adapted to be fastened directly to a heat exchanger tube sheet adjacent a selected number of tubes to be cleaned, the apparatus comprising:

a flat base plate having a first portion and a second portion extending at an angle from the first portion, the first and second portions forming an inner center corner therebetween, the flat base plate having an outer center corner between the first portion and the second portion spaced from the inner center corner, a first outer end corner and a second outer end corner;

a support post adjacent each of the outer end corner, the outer center corner and the inner center corner each fastened at one end to the base plate;

a top plate fastened to an opposite end of each support post; and an extensible scissor arm assembly between the base plate and the too plate having a first arm and a second arm each pivotally fastened via one of a first and second shoulder sleeve to the inner center corner support post, wherein the extensible scissor arm assembly is operable to position a lance drive mechanism carried by wrist joint members at a distal end of the scissor arm assembly at precise X and Y coordinates adjacent the heat exchanger tube sheet.

2. The apparatus according to claim 1 wherein the precise X and Y coordinates are determined by positions of X and Y actuator cylinders connected to a common connection point of a scissor arm assembly extension hinge linkage.

3. The apparatus according to claim 1 wherein the first and second arms each includes a humerus member, an elbow joint, and an ulna member connected between the elbow joint and a wrist joint, wherein the first and second arms are independently carried by the first and second shoulder sleeves rotatably fastened to the inner center corner post.

4. The apparatus according to claim 2 wherein the scissor arm assembly comprises first and second extensions each having one end rigidly attached to one of the first and second shoulder sleeves and an opposite end attached to the scissor arm assembly extension hinge linkage.

5. The apparatus according to claim 1 further comprising an X coordinate actuator having one end fastened to the base plate adjacent the first outer end corner and a Y coordinate actuator having one end fastened to the base plate adjacent the second outer end corner.

6. The apparatus according to claim 1 further comprising an X coordinate actuator and a Y coordinate actuator each having an extendable end fastened together.

7. The apparatus according to claim 4 further comprising an X coordinate actuator and a Y coordinate actuator each having an extendable end fastened to the scissor arm assembly extension-common connection point.

8. The apparatus according to claim 6 wherein the actuator extendable ends are fastened together at a scissor arm assembly extension common connection point.

9. The apparatus according to claim 8 wherein the X coordinate actuator has one end fastened to the base plate adjacent the first outer end corner and the Y coordinate actuator has one end fastened to the base plate adjacent the second outer end corner.

10. The apparatus according to claim 1 further comprising a first and second radius member each parallel to one of the first and second ulnar members respectively each extending between one of the elbows and the wrist joints.

11. A flexible lance drive positioning apparatus comprising:

a flat base plate having a first portion and a second portion extending at a right angle from the first portion, adapted to be fastened directly to a heat exchanger tube sheet adjacent a selected number of tubes to be cleaned, the first and second portions forming an inner center corner therebetween, the base plate having an outer center corner spaced from the inner center corner, a first outer end corner and a second outer end corner;

a support post fastened at one end to the base plate adjacent each of the first and second outer end corners, the outer center corner and the inner center corner;

a common top plate fastened to an opposite end of each support post; and an extensible scissor arm assembly between the base plate and the common top plate having a first arm and a second arm each pivotally fastened to the inner center corner support post operable to position a lance drive mechanism carried by wrist joint members at a distal end of the scissor arm assembly at precise X and Y coordinates adjacent the heat exchanger tube sheet.

12. The apparatus according to claim 11 wherein the precise X and Y coordinates are determined by positions of X and Y actuator cylinders connected to a common connection point of a scissor arm assembly extension hinge linkage.

13. The apparatus according to claim 11 wherein the first and second arms each includes a humerus member, an elbow joint, and an ulna member connected between the elbow joint and a wrist joint, wherein the first and second arms are each independently carried by one of first and second shoulder sleeves rotatably fastened to the inner center corner post.

14. The apparatus according to claim 12 wherein the scissor arm assembly comprises first and second hinged extensions each having one end rigidly attached to one of the first and second shoulder sleeves and an opposite end pivotally attached via the scissor arm assembly extension hinge linkage to the common connection point.

15. The apparatus according to claim 11 further comprising an X coordinate actuator having one end fastened to the base plate adjacent the first outer end corner and a Y coordinate actuator having one end fastened to the base plate adjacent the second outer end corner.

16. The apparatus according to claim 11 further comprising an X coordinate actuator and a Y coordinate actuator each having an extendable end fastened together.

17. The apparatus according to claim 14 further comprising an X coordinate actuator and a Y coordinate actuator each having an extendable end fastened to the common connection point.

18. The apparatus according to claim 16 wherein the actuator extendable ends are fastened together at a common connection point of a scissor arm assembly extension hinge linkage.

19. The apparatus according to claim 18 wherein the X coordinate actuator has one end fastened to the base plate adjacent the first outer end corner and the Y coordinate actuator has one end fastened to the base plate adjacent the second outer end corner.

20. The apparatus according to claim 11 further comprising a first and second radius member each parallel to one of the first and second ulnar members respectively each extending between one of the elbows and the wrist joints.

* * * * *